US007624979B2

(12) United States Patent
Masutani

(10) Patent No.: US 7,624,979 B2
(45) Date of Patent: Dec. 1, 2009

(54) SHEET TRANSPORT APPARATUS

(75) Inventor: Hironori Masutani, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 118 days.

(21) Appl. No.: 11/727,733

(22) Filed: Mar. 28, 2007

(65) Prior Publication Data

US 2007/0246878 A1 Oct. 25, 2007

(30) Foreign Application Priority Data

Apr. 21, 2006 (JP) ..... 2006-117788

(51) Int. Cl.
*B65H 3/34* (2006.01)

(52) U.S. Cl. ..... 271/167; 271/147; 271/157; 271/160; 271/121; 271/127

(58) Field of Classification Search ..... 271/147, 271/157, 160, 167, 121, 127
See application file for complete search history.

(56) References Cited

U.S. PATENT DOCUMENTS 5,253,854 A * 10/1993 Tanoue et al. ..... 271/10.12
5,573,235 A * 11/1996 Asai ..... 271/121
5,794,928 A * 8/1998 Araseki et al. ..... 271/9.08
5,863,036 A * 1/1999 Tanaka et al. ..... 271/10.11
6,000,689 A * 12/1999 Furuki et al. ..... 271/10.11
6,042,103 A * 3/2000 Yraceburu et al. ..... 271/118
6,059,281 A * 5/2000 Nakamura et al. ..... 271/119
6,059,282 A * 5/2000 Jang ..... 271/160
6,129,348 A * 10/2000 Park ..... 271/160
6,158,733 A * 12/2000 Muraki ..... 271/127
6,305,682 B1 * 10/2001 Saito et al. ..... 271/10.11
6,793,425 B2 * 9/2004 Yoshikawa et al. ..... 400/624
6,880,822 B2 * 4/2005 Fukushima et al. ..... 271/157
7,104,539 B2 * 9/2006 Shimoyama ..... 271/167
2001/0017440 A1 * 8/2001 Minamishin et al. ..... 271/10.11
2006/0180994 A1 * 8/2006 Jang et al. ..... 271/126
2007/0290432 A1 * 12/2007 Kojima ..... 271/147
2008/0217839 A1 * 9/2008 Bingham et al. ..... 271/121

FOREIGN PATENT DOCUMENTS

JP 11-165899 A 6/1999

* cited by examiner

*Primary Examiner*—Patrick H Mackey
*Assistant Examiner*—Prasad V Gokhale
(74) *Attorney, Agent, or Firm*—Smith Patent Office

(57) ABSTRACT

A sheet transport apparatus includes a pair of transporting rollers, a table and a table drive mechanism. The pair of transporting rollers consist of a driving roller and a driven roller. On the table are stacked a plurality of recording media to be supplied to the pair of transporting rollers. The table drive mechanism moves the table between two positions of a transport position and a standby position. The table drive mechanism descends the table to the standby position, from the transport position, after the uppermost recording medium of the recording media stacked on the table at the transport position is sandwiched between the driving roller and the driven roller.

3 Claims, 5 Drawing Sheets

SHEET TRANSPORT APPARATUS

BACKGROUND OF THE INVENTION

1. Filed of the Invention

The present invention relates to a sheet transport apparatus that sequentially transports a plurality of stacked recording media from the uppermost thereof.

2. Description of Related Art

A sheet material supply apparatus disclosed in a Japanese Patent Unexamined Publication No. Hei 11-165899 has a pickup roller that sends out stacked and accommodated sheet materials, and a feed roller and a retard roller that separately supply the sheet materials one by one sent from the pickup roller. In the sheet material supply apparatus, a feed guide is pivotably arranged to a feed roller axis supporting the feed roller. Accordingly, the flip-flop at a center of the leading end of the sheet material is suppressed and the multifeed of the sheet materials is prevented.

SUMMARY OF THE INVENTION

In recent years, in order to print a photograph, an ink-jet printer is increasingly used which performs a printing on photo printing paper that is non-photosensitive and thick. In an ink-jet printer for business use, an image is typically recorded on the photo printing paper unwound from a roll body wound in a roll shape. However, in some circumstances, it is required to record an image on the photo printing paper that is preliminarily cut in a predetermined length. A manual tray or feed cassette, which is a supply source of the photo printing paper cut in a predetermined length, preferably piles up the photo printing papers as many as possible while stacking them. However, since the photo printing paper is a thick and is thus elastic, even though an operator carries out an operation of riffling or flipping the photo printing papers stacked, before the operator puts the papers in the manual tray or feed cassette, the air is little interposed between the photo printing papers just after the papers are put in the tray. Accordingly, when the photo printing paper is used as a recording medium, there sometimes occurs a multifeed phenomenon where several photo printing papers are transported from the manual tray or feed cassette while being overlapped with each other.

A main object of the present invention is to provide a sheet transport apparatus capable of preventing multifeed of recording media even when recording media that are a little thick are used.

A sheet transport apparatus of the present invention comprises a pair of transporting rollers, a table and a table drive mechanism. The pair of transporting rollers consist of a driving roller and a driven roller disposed below the driving roller and transport a recording medium sandwiched between the driving roller and the driven roller. On the table are stacked a plurality of recording media to be supplied to the pair of transporting rollers. The table drive mechanism moves the table between a transport position at which the uppermost recording medium of the recording media stacked on the table contacts the driving roller and a standby position, below the transport position, at which the uppermost recording medium does not contact the driving roller. The table drive mechanism descends the table to the standby position from the transport position, after the uppermost recording medium of the recording media stacked on the table at the transport position is sandwiched between the driving roller and the driven roller.

According to the above structure, after the uppermost recording medium of the recording media stacked on the table is sandwiched between the pair of transporting rollers, when the table is moved to the standby position from the transport position, almost or all recording media except the uppermost recording medium are dropped as the table descends. During the dropping, the recording media, which are overlapped with each other, are spaced somewhat, so that air is interposed therebetween. In other words, whenever the recording medium is supplied to the pair of transporting rollers, the operation of riffling or flipping almost or all the recording media stacked on the table is automatically carried out, so that it is possible to periodically interpose the air between the recording media stacked on the table. Accordingly, even though the recording medium, which is a little thick, is used, the multifeed little occurs that two or more recording media are fitted between the pair of transporting rollers while being overlapped with each other.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
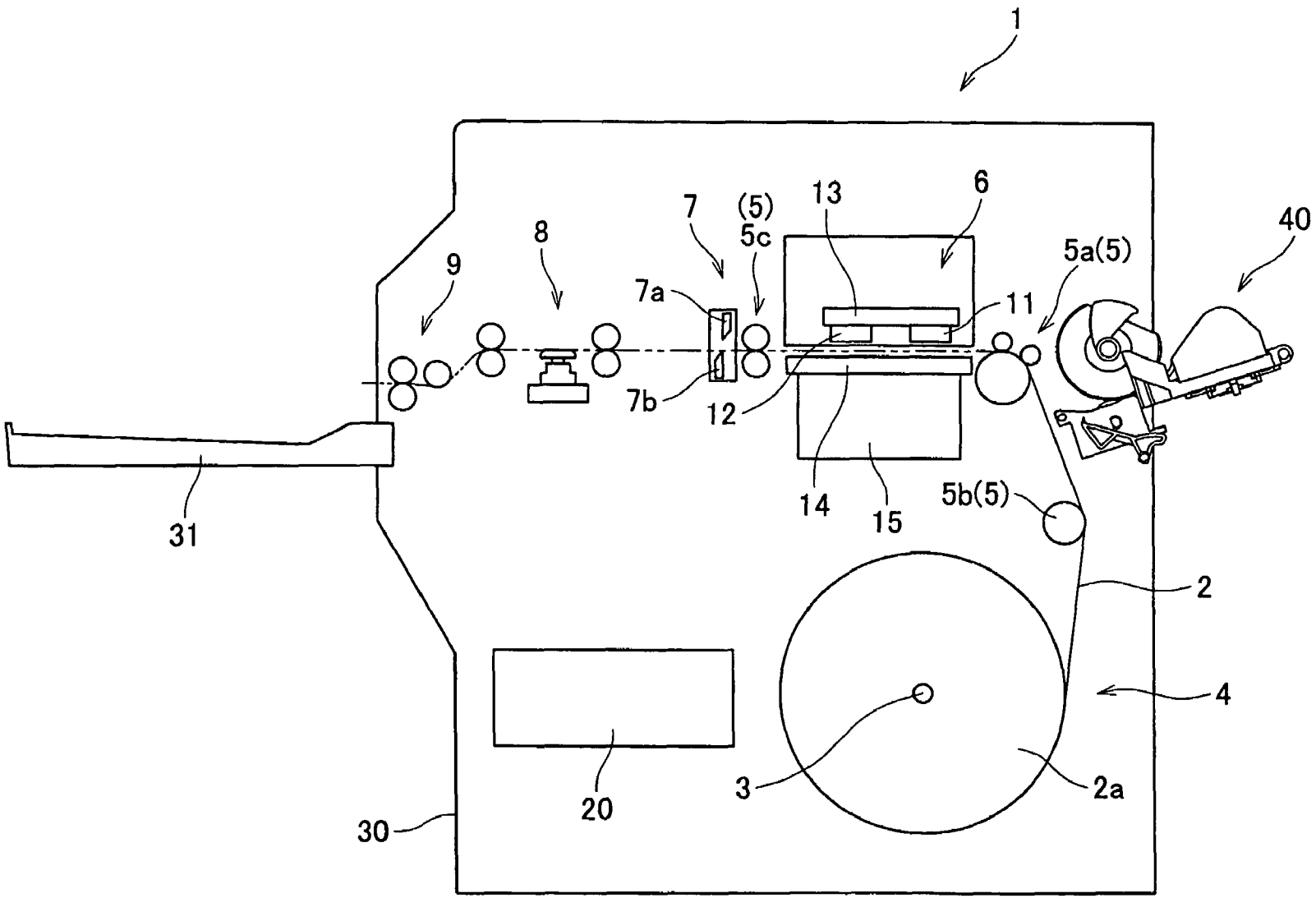
FIG. 1 shows a schematic structure of an ink-jet type printer having a sheet transport apparatus according to an embodiment of the invention.

An ink-jet type printer 1 for business use shown in FIG. 1 includes a paper supply unit 4, a transport roller unit 5, an ink-jet printing unit 6, a cutting unit 7, a dot impact printing unit 8 and a discharge roller unit 9 in a casing 30 having a substantially rectangular parallelepiped shape. To the casing 30 are attached a discharge tray 31 for receiving paper discharged from the discharge roller unit 9 and a sheet transport apparatus 40 for manually inserting a recording medium such as photo printing paper having a predetermined length. Operations of the respective parts of the ink-jet type printer 1 are controlled by a controller 20 disposed in the casing 30.

The sheet supply unit 4 is loaded with long photo printing paper 2 having a roll body 2*a* wound in a roll form. The roll body 2*a* of the photo printing paper 2 is held on a drum 3 that is rotatable around the center axis thereof. The photo printing paper 2 unwound from the roll body 2*a* passes to the sheet transport apparatus 40, the ink-jet printing unit 6, the cutting unit 7, the dot impact printing unit 8 and the discharge roller unit 9 along a transport route formed in the casing 30 and is then discharged to the discharge tray 31. The direction that the photo printing paper 2 is moved along the transport route is referred to as a transport direction.

The transport roller unit 5 has, with respect to the transport direction, a pair of transporting rollers 5*a* that are disposed upstream of the ink-jet printing unit 6, a turn roller 5*b* disposed between the paper supply unit 4 and the pair of transporting rollers 5*a*, and a pair of press rollers 5*c* that are disposed downstream of the pair of transporting rollers 5*a*. The pair of transporting rollers 5*a* transport the photo printing paper 2 unwound from the roll body 2*a* in the downstream direction. The press rollers 5*c* transport the photo printing paper 2 between the ink-jet printing unit 6 and the cutting unit 7 in the downstream direction.

The ink-jet printing unit 6 has two printing heads 11, 12, a carriage 13, a printing platen 14 and a suction fan 15. The two printing heads 11, 12 are spaced at an interval along the transport direction (in FIG. 1, direction from right to left, hereinafter, referred to as "sub scanning direction") of the photo printing paper 2 in the ink-jet printing unit 6. The two printing heads 11, 12 are respectively provided with a number of ejection nozzles (not shown) capable of ejecting color inks toward a surface of the photo printing paper 2. The carriage 2 is provided to hold the two printing heads 11, 12 and can be reciprocally moved along a direction (in FIG. 1, direction perpendicular to the sheet) perpendicular to the sub scanning direction, i.e., a main scanning direction.

The platen 14 has a paper support surface that confronts the ejection faces of the printing heads 11, 12 in parallel. The paper support surface supports the photo printing paper 2 that is disposed to confront the printing heads 11, 12. The platen 14 has a number of suction holes (not shown) that are uniformly formed over a substantially entire width of the paper support surface. The suction fan 15 is disposed to confront the printing heads 11, 12 while interposing the platen 14 between the heads and the fan. The suction fan 15 generates suction force capable of sucking the air into the suction holes on the paper support surface, thereby sucking the photo printing paper 2 to the paper support surface.

The cutting unit 7 has a movable knife 7*a* that is disposed above the transport route of the photo printing paper 2 and a fixed knife 7*b* that is disposed below the transport route. Each of the moveable knife 7*a* and the fixed knife 7*b* is a rectangular knife having a width that is somewhat larger than that of the photo printing paper 2. The moveable knife 7*a* is connected to a motor (not shown) that is controlled by the controller 20, so that it can be vertically moved. The photo printing paper 2 having completed the printing, which is transported from the upstream along the transport route, is cut in a lateral direction by the interaction of the moveable knife 7*a* and the fixed knife 7*b*. The photo printing paper 2 having completed the printing is divided into a predetermined length as it is cut in the cutting unit 7.

The dot impact printing unit 8 has a number of tiny pins that selectively impact the photo printing paper 2 through an ink ribbon. The pins selectively go up and down, based on the control of the controller 20, thereby printing additional information, such as printing date, reference number and the like, on the lower surface of the photo printing paper 2. The discharge roller unit 9 discharges the photo printing paper 2 having completed the printing to the outside of the casing 30.

The controller 20 executes a predetermined processing on an image signal supplied from an input interface (not shown) to produce image data and supplies a printing signal including the image data to the ink-jet printing unit 6. The controller 20 controls a transport timing of the photo printing paper 2 by the transport roller unit 5 and the discharge roller unit 9, a movement timing of the carriage 13, an ejection timing of ink from the printing heads 11, 12, a cutting timing of the photo printing paper 2 by the cutting unit 7 and a printing timing by the dot impact printing unit 8.

Figure 2:
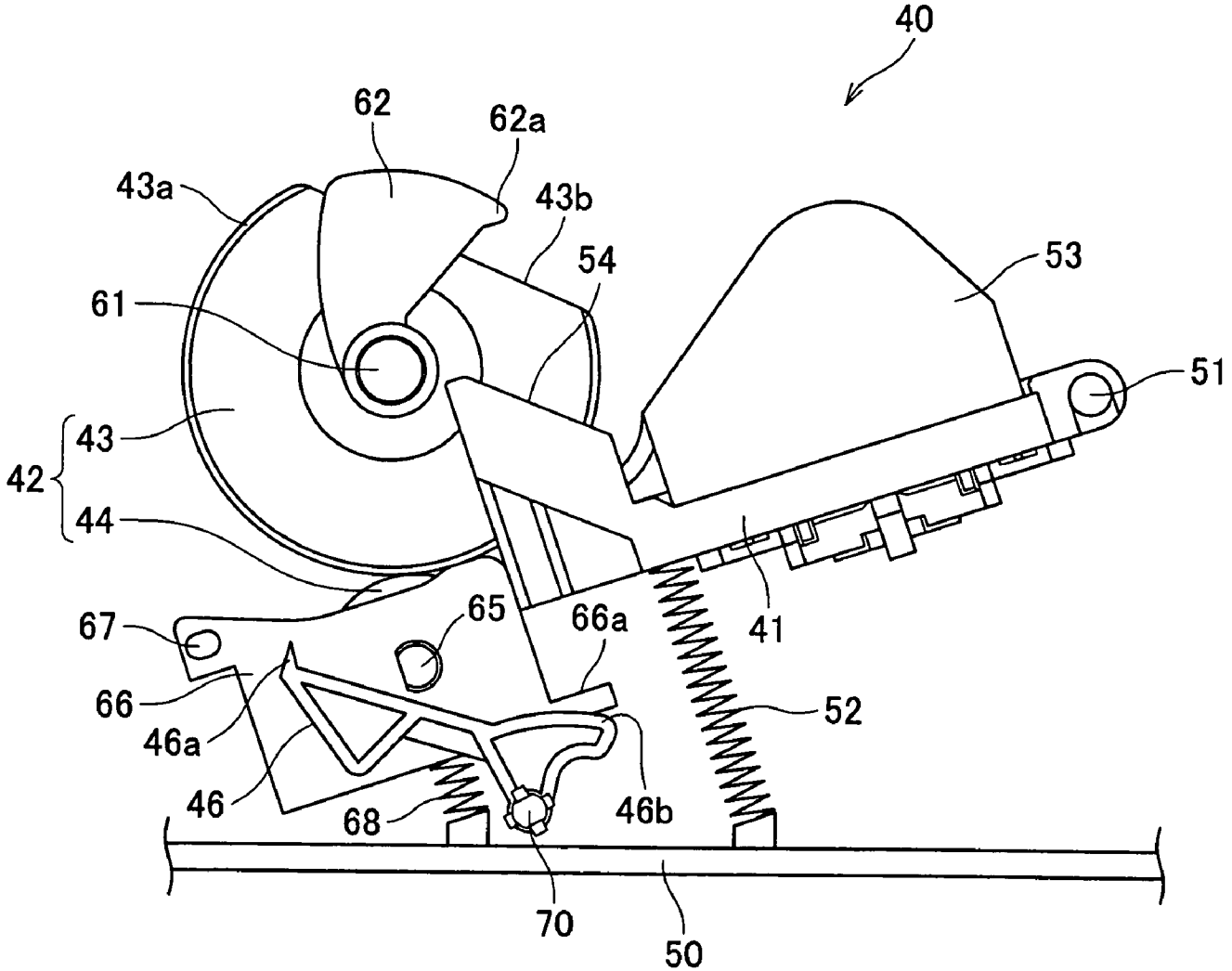
FIG. 2 is a partial side view for illustrating a structure of the sheet transport apparatus shown in FIG. 1.
Figure 3:
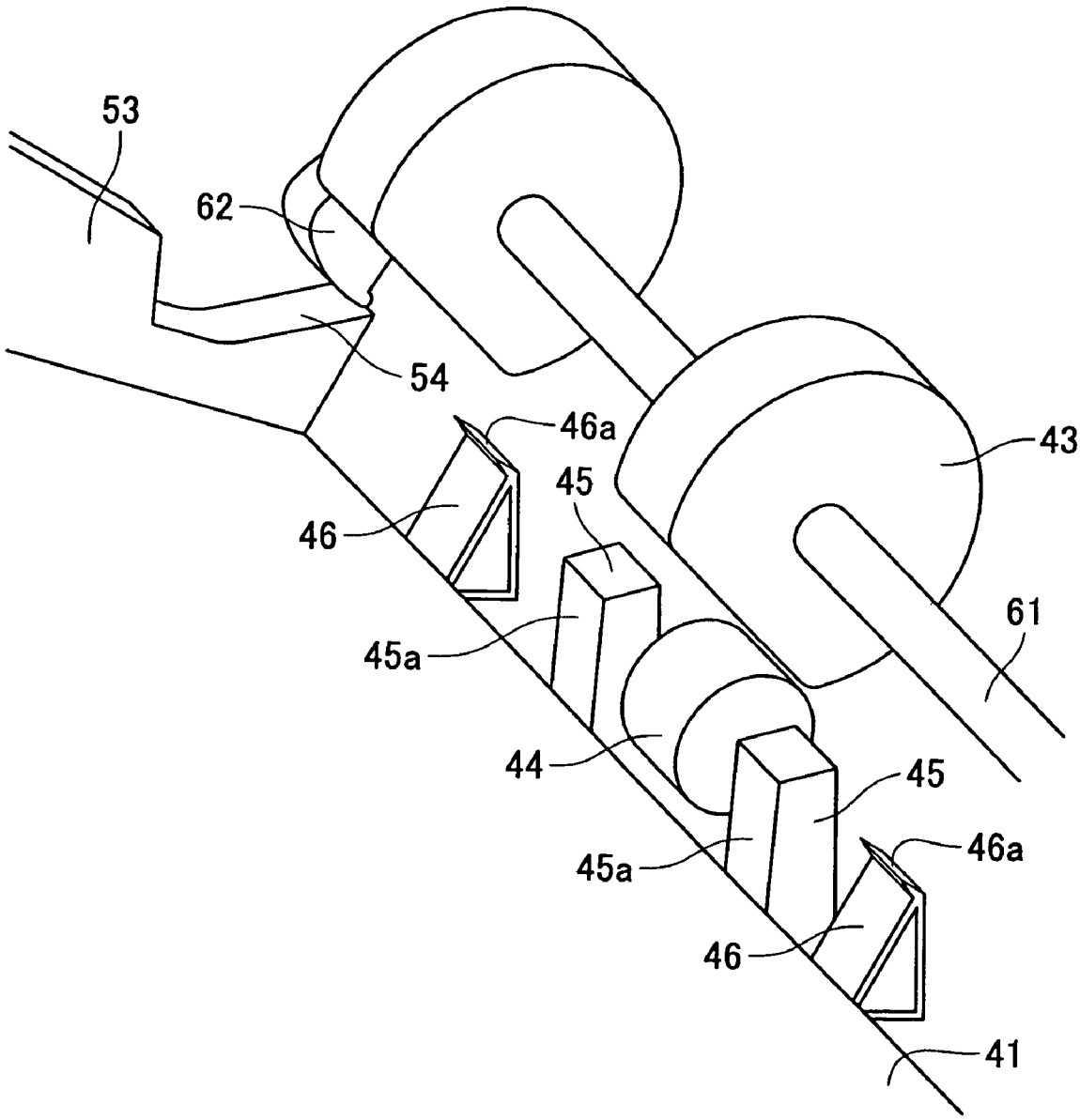
FIG. 3 is a partially enlarged perspective view of a sheet transport apparatus.

In the followings, it is described detailed structures of the sheet transport apparatus 40 with reference to FIGS. 2 and 3. The sheet transport apparatus 40 includes a table 41, a pair of transporting rollers 42, stoppers 45 and restackers 46. On the table 41 are stacked a number of photo printing papers each having a predetermined length. The pair of transporting rollers 42 consist of a driving roller 43 and a driven roller 44. The pair of transporting rollers 42 sequentially transport the photo printing papers stacked on the table 41, from the uppermost paper one by one, in the downstream direction. The stoppers 45 constrain the transport of the photo printing paper so that the number of the photo printing papers to be supplied to the pair of transporting rollers 42 is equal to or less than a predetermined number. The stoppers 45 are fixed to a flat plate 50. The restackers 46 again stack one or more photo printing papers on the table 41, which are supplied to the pair of transporting rollers 42 but are not sandwiched between the pair of transporting rollers 42.

In FIG. 2, a left end of the table 41, which is a plate member, is located at a position that is upstream of the driven roller 44 and overlaps with the driving roller 43 with respect to the transport direction. The table 41 is inclined so that a right end thereof is higher as it gets away from the pair of transporting rollers 42. The table 41 can swing around an axis 51 adjacent to the right end thereof. The table 41 swings around the axis 51, so that it can move between a transport position at which the photo printing paper can be supplied to the pair of transporting rollers 42 and a standby position at which the photo printing paper cannot be supplied to the pair of transporting rollers 42. In addition, a coil spring 52 is disposed between a lower surface of the table 41 and the flat plate 50 that is one member of the sheet transport apparatus 40. The table 41 is elastically biased in a direction that it swings in a clockwise direction due to elastic force of the coil spring 52, i.e., in an upward direction.

The transport position of the table 41 is a position at which the uppermost photo printing paper of the photo printing papers stacked is pressed against the driving roller 43 by the elastic force of the coil spring 52 and the photo printing paper can be supplied to the pair of transporting rollers 42. Accordingly, when the driving roller 43 is rotated while the table 41 is at the transport position, the uppermost photo printing paper is introduced between the driving roller 43 and the driven roller 44. In the mean time, the standby position of the table 41 is a position at which the table 41 is below the transport position, i.e., a position that the table 41 is much swung into a counterclockwise direction than the transport position. In the standby position, the photo printing paper cannot be supplied to the pair of transporting rollers 42.

The table 41 includes two guide plates 53. The two guide plates 53 protrude from both sides of the table 41. The photo printing papers stacked on the table 41 are fitted between the two guide plates 53. A pressed surface 54, which is periodically pushed downward by a pusher 62 (described later) as the driving roller 43 is rotated, is formed adjacent to the left end of the guide plate 53. The pressed surface 54 is a tapered surface having a height that becomes higher as it approaches the left end of the table 41. Since the pressed surface 54 is a tapered surface, the table 41 swings around the axis 51 against the elastic force of the coil spring 52 as the driving roller 43 is rotated, after the pusher 62 contacts the pressed surface 54. Then, the table 41 is moved to the standby position from the transport position. When the pusher 62 does not push the pressed surface 54, the table 41 is at the transport position. When the pressed surface 54 pushed by the pusher 62 is moved to the undermost, the table 41 is at the standby position.

The pair of transporting rollers 42 has a driving roller 43 and a cylindrical driven roller 44 disposed below the driving roller 43. The driving roller 43 is rotated together with a shaft 61 at the center thereof. An outer periphery of the driving roller 43 consists of a pressing surface 43*a* having an arc shape that is equal in distance from a central axis of the shaft 61 and has a central angle of approximately 240°, and a non-pressing surface 43*b* that is a plane connecting both ends of the pressing surface 43*a*. The driving roller 43 can sandwich the photo printing paper between the pressing surface 43*a* and the driven roller 44 when the pressing surface 43*a* confronts the driven roller 44. In the mean time, the driving roller 43 cannot sandwich the photo printing paper between the non-pressing surface 43*b* and the driven roller 44 when the non-pressing surface 43*b* confronts the driven roller 44.

As shown in FIG. 3, the pusher 62 is fixed to one end of the shaft 61. The pusher 62 is a plate member having a substantially triangular shape. An outer periphery of the pusher 62 is arc-shaped to have a same diameter as the driving roller 43. The pusher 62 is rotated together with the shaft 61. When the pusher 62 is rotated as the shaft 61 rotates, the leading end 62*a* of the pusher 62 contacts the pressed surface 54. After that, the pusher 62 is rotated while slowly pushing down the pressed surface 54 downward. As can be seen from FIG. 2, the leading end 62*a* of the pusher 62 is more away from the center of the shaft 61 than the non-pressing surface 43*b*, in a range outside an angle range corresponding to the pressing surface 43*a*, i.e., in an angle range corresponding to the non-pressing surface 43*b*.

The driven roller 44 is supported to an axis 65 parallel to the shaft 61 so that it can be rotated. The axis 65 is supported to a supporter 66. The supporter 66 is adapted to swing about an axis 67 (parallel to the axis 65) penetrating the vicinity of the left end thereof (an end farthest from the table 41). A coil spring 68, which is an elastic member, is disposed between a lower surface of the supporter 66 and the flat plate 50. The supporter 66 is elastically biased in a direction that it swings in a counterclockwise direction due to elastic force of the coil spring 68, i.e., in an upward direction.

A convex 66*a* protrudes from a right lower end of the supporter 55 in the right direction. When the table 41 is moved to the standby position from the transport position, a left lower end of the table 41 pushes the convex 66*a* downward. Thereby, the support 66 is rotated in the clockwise direction against the elastic force of the coil spring 68. To the contrary, when the table 41 is moved to the transport position from the standby position, the supporter 66 is rotated in the counterclockwise direction. When the table 41 does not push the convex part 66*a*, the driven roller 44 supported to the supporter 66 pushes the driving roller 43. In the mean time, when the table 41 pushes the convex 66*a*, the driven roller 44 is apart from the driving roller 43.

A pair of stoppers 45 sandwich the driven roller 44. The stoppers 45 and the driven roller 44 are on a line parallel to the shaft 61. Each of the stoppers 45 has a contact surface 45*a* that is a side surface facing to the upstream with respect to the transport direction. The two contact surfaces 45*a* provided to right and left of the driven roller 44 are at the same position upstream of the position at which the driving roller 43 and the driven roller 44 sandwich the photo printing paper, with respect to the transport position. When the table 41 is at the transport position, the leading ends of the photo printing papers, except the predetermined number of papers (three sheets of paper in this embodiment) from the uppermost paper of the photo printing papers stacked on the table 41, are contacted to the contact surfaces 45*a*. The photo printing papers contacting the contact surfaces 45*a* of the stoppers 45 are not supplied to the pair of transporting rollers 42 even when the table 41 is at the transport position. Conversely, the heights of the stoppers 45 are adjusted so that when the table 41 is at the transport position, only the predetermined number of photo printing papers from the uppermost paper of the photo printing papers stacked on the table 41 are supplied to the pair of transporting rollers 42 while not being contacted to the contact surfaces 45*a*.

A pair of restackers 46 sandwich the pair of stoppers 45. The restackers 46 and the stoppers 45 are located on a line parallel to the shaft 61. The restackers 46 are adapted to swing around a fixed axis 70 parallel to the shaft 61. One end of each restacker 46 protrudes in the clockwise direction and the leading end thereof has a sharp claw 46*a*. A linear length from the axis 70 to the claw 46*a* is approximately same as a linear length from the axis 70 to the surface of the driving roller 43. The other end 46*b* of each restacker 46 is bulged in the right direction so that it contacts the left lower end of the table 41 when the table 41 is moved to the standby position from the transport position. When the restackers 46 are pushed down by the table 41, the restackers 46 are rotated in the clockwise direction. At this time, the claws 46*a* are near the contact position of the driving roller 43 and the driven roller 44, so that the claws contact a lower surface of the single photo printing paper sandwiched between the pair of transporting rollers 42. After that, the claws 46*a* are moved to the table 41 along the lower surface of the one photo printing paper. At this time, the leading ends of the (predetermined number—one) of photo printing papers, which are supplied to the pair of transporting rollers 42 from the table 41 but are not sandwiched between the pair of transporting rollers 42, are contacted to the front surfaces of the restackers 46. The restackers 46 restack the (predetermined number—one) of photo printing papers, which are contacted to the front surfaces thereof, on the table 41 while rotating in the clockwise direction. When the table 41 is returned to the transport position, the restackers 46 are swung in the counterclockwise direction due to its own weight, so that they are returned to the position shown in FIG. 2.

As described above, when the leading end 62*a* of the pusher 62 pushes down the pressed surface 54 of the table 41, the table 41 swings about the axis 51, thereby moving to the standby position from the transport position. Then, when the pusher 62 does not push the table 41 as the shaft 61 rotates, the table 41 is returned to the transport position from the standby position due to the elastic force of the coil spring 52. In other words, the rotation period of the driving roller 43 is set to be same as the period of the table 41 that the table moves from the transport position to the standby position and then again to the transport position therefrom. In this embodiment, the axis 51, the coil spring 52, the pressed surface 54, the shaft 61 and the pusher 62 constitute the table drive mechanism.

Figure 4A:
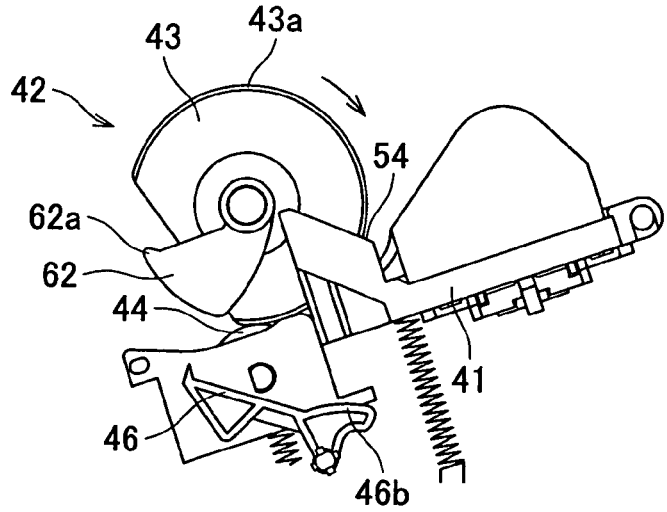
FIGS. 4A, 4B and 4C show an operation of a sheet transport apparatus, focusing on a table.
Figure 4B:
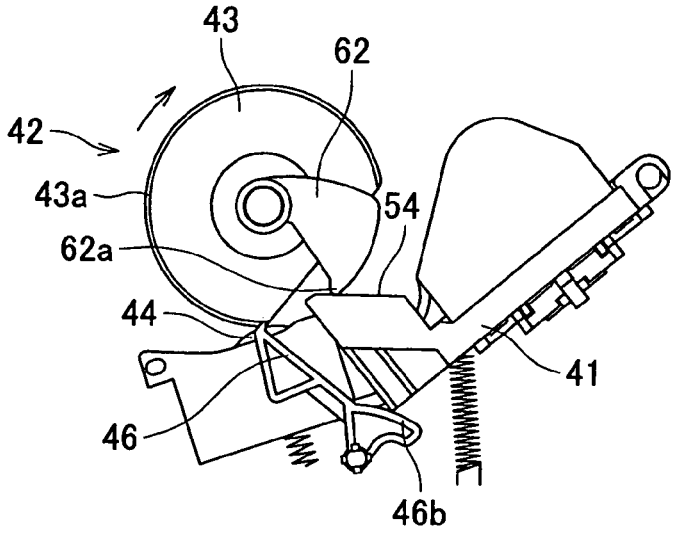
Figure 4C:
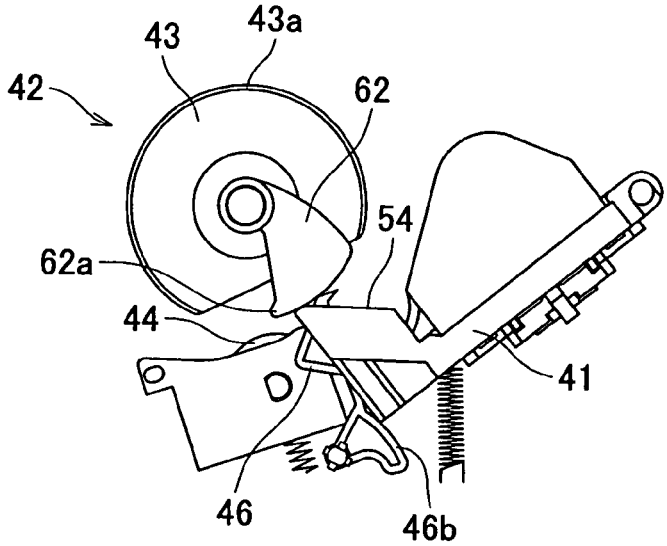
Figure 5A:
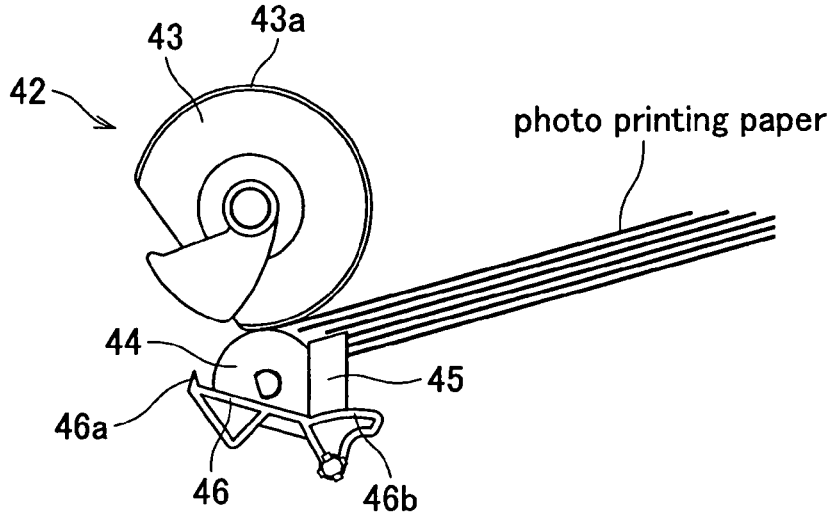
FIGS. 5A, 5B and 5C shows an operation of a sheet transport apparatus, focusing on a photo printing paper.
Figure 5B:
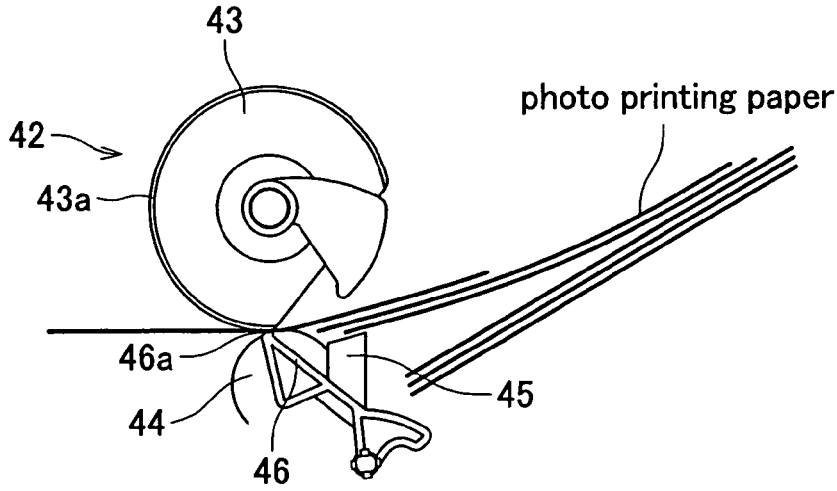
Figure 5C:
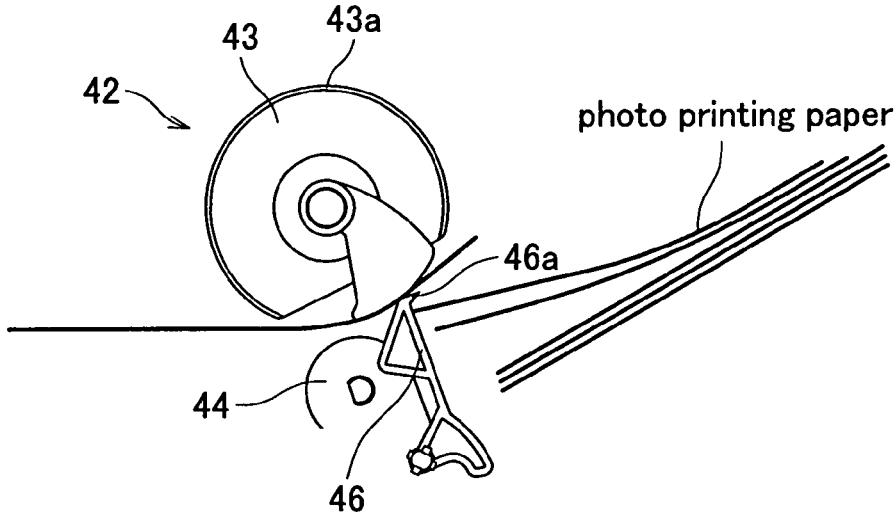

In the followings, an operation of the sheet transport apparatus 40 is described with reference to FIGS. 4A to 4C and 5A to 5C. FIGS. 4A and 5A, 4B and 5B and 4C and 5C are views at the same timings, respectively. In FIGS. 4A to 4C, the photo printing paper is not shown. In FIGS. 5A to 5C, the table 41 is not shown.

In FIGS. 4A and 5A, it is shown the sheet transport apparatus 40 at the timing that the pressing surface 43*a* starts to contact the driven roller 44 as the driving roller 43 is rotated. At this timing, since the leading end 62*a* of the pusher 62 does not push down the pressed surface 54 of the table 41, the table 41 is at the transport position. The upper surface of the uppermost photo printing paper of the photo printing papers stacked on the table 41 is pressed against the pressing surface 43*a* of the driving roller 43 due to the elastic force of the coil spring 52. Accordingly, as the driving roller 43 is rotated, the uppermost photo printing paper is transported toward the front direction and is introduced between the driving roller 43 and the driven roller 44. The second and third photo printing papers from the uppermost are pulled to the uppermost photo printing paper and are thus a little transported toward the front direction. However, these two photo printing papers are not introduced between the driving roller 43 and the driven roller 44. The other photo printing papers except the upper three papers are contacted to the contact surfaces 45*a* of the stoppers 45 to be stacked on the table 41 and are not supplied to the pair of transporting rollers 42. After that, the single photo printing paper introduced between the driving roller 43 and the driven roller 44 is slowly transported toward the front as the driving roller 43 is rotated, while being sandwiched between the driving roller 43 and the driven roller 44.

FIGS. 4B and 5B show the sheet transport apparatus 40 at the timing just before the pressing surface 43*a* is apart from the driven roller 44. At this timing, the leading end 62*a* of the pusher 62 pushes down the pressed surface 54 of the table 41, and the table 41 is in the course of the descent to the standby position from the transport position. The photo printing papers on the table 41, except the first to third photo printing papers from the uppermost, are dropped as the table 41 descends, while being stacked on the table 41. The uppermost photo printing paper is transported to the front while being sandwiched between the driving roller 43 and the driven roller 44. The leading ends of the second and third photo printing papers from the uppermost are not introduced between the driving roller 43 and the driven roller 44 but are on the stoppers 45. Accordingly, the two photo printing papers are not dropped even when the table 41 descends. In addition, at this time, the right lower end of the table 41 pushes down the other ends 46*b* of the restackers 46 and the restackers 46 are at positions that they are swung in the clockwise direction much more, as compared to the positions shown in FIGS. 4A and 5A. The claws 46*a* of the restackers 46 are at the contact position of the driving roller 43 and the driven roller 44, so that they contact the lower surface of the uppermost photo printing paper.

FIGS. 4C and 5C show the sheet transport apparatus 40 at an intermediate timing from the timing of FIGS. 4B and 5B to the timing of FIGS. 4A and 5A. At this timing, the pressing surface 43*a* and the driven roller 44 are apart from each other. In addition, the leading end 62*a* of the pusher 62 displaces the pressed surface 54 of the table 41 to the undermost, and the table 41 is at the standby position. The uppermost photo printing paper is forward transported much more, as compared to the position shown in FIGS. 4B and 5B, while being sandwiched between the driving roller 43 and the driven roller 44. In addition, the restackers 46 are at positions that they are swung in the clockwise direction much more, as compared to the positions shown in FIGS. 4B and 5B. The uppermost photo printing paper is sandwiched between the claws 46*a* and the outer periphery of the pusher 62. During the transition from FIGS. 4B and 5B to FIGS. 4C and 5C, the second and third photo printing papers from the uppermost contact the front surfaces of the restackers 46. As the restackers 46 are swung in the clockwise direction, the restackers push the two photo printing papers in the rearward direction, i.e., toward the table 41. As a result, the two photo printing papers are dropped on the table 41. The two photo printing papers are again stacked on the table 41 as the uppermost and second photo printing papers. In addition, at this time, since the supporter 66 pushed by the table 41 is at the position that it is rotated in the clockwise direction, the driven roller 44 is spaced from the driving roller 43. Accordingly, the driving roller 43 and the driven roller 44 are securely released from each other.

As described above, according to the sheet transport apparatus 40 of this embodiment, after the uppermost photo printing paper of the photo printing papers stacked on the table 41 is sandwiched between the pair of transporting rollers 42, the table 41 is moved to the standby position from the transport position. At this time, most of the photo printing papers, except the predetermined number of the photo printing papers from the uppermost, are dropped as the table 41 descends. During the dropping, the photo printing papers overlapped with each other are somewhat spaced from each other, so that the air is interposed between the neighboring photo printing papers. In other words, whenever the predetermined number of photo printing papers is supplied to the pair of transporting rollers 41, since the operation of riffling or flipping most of the photo printing papers (in this embodiment, the predetermined number—two of photo printing papers) stacked on the table 41, except the uppermost photo printing paper, is automatically carried out, it is possible to periodically interpose the air between the photo printing papers stacked on the table 41. Accordingly, even though the photo printing paper, which is a little thick, is used, the multifeed little occurs that two or more photo printing papers are sandwiched between the pair of transporting rollers 42 while being overlapped with each other.

In addition, it is possible to simplify the structure of the table drive mechanism by using the elastic force of the coil spring 52. In addition to this, since it is possible to move the table 41 in synchronization with the rotation of the driving roller 43, the structure of the table drive mechanism can be further simplified.

Furthermore, since the stoppers 45 are provided, it is possible to securely prevent the photo printing papers more than the predetermined number from being supplied to the pair of transporting rollers 42. In addition, even though the two or more photo printing papers are simultaneously supplied to the pair of transporting rollers 42, since the restackers 46 restack the (predetermined number—one) of photo printing papers on the table 41, a transport trouble such as paper jam little occurs. Even when the restackers 46 restack the (predetermined number—one) of photo printing papers on the table 41, the (predetermined number—one) of photo printing papers are dropped from the stoppers 45. Even at this time, the operation of riffling or flipping the photo printing papers is automatically carried out, like when the table 41 descends. Accordingly, when the photo printing paper is supplied to the transporting papers 42 next time, the multifeed of photo printing papers little occurs.

In the above embodiment, the stoppers 45 can supply to the pair of transporting rollers 42 the three photo printing papers from the uppermost of the photo printing papers stacked on the table 41. However, by changing the height of the stoppers 45, it is possible to set the number of the photo printing papers to be supplied to the pair of transporting rollers 42, as any number of one or more sheets.

In addition, according to the above embodiment, the coil spring 52, the shaft 61, the pusher 62 and the pressed surface 54 of the table 41 constitute the table drive mechanism. However, the table drive mechanism may not use the coil spring 52 or the pusher 62.

Furthermore, the sheet transport apparatus of the present invention may not have the stoppers 45 and the restackers 46 as described in the above embodiment. The sheet transport apparatus of the present invention may be applied so as to transport a recording medium except the photo printing paper. In addition, the sheet transport apparatus of the present invention may be applied to a device except the ink-jet printer, as long as the device transports a recording medium.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A sheet transport apparatus comprising:

a pair of transporting rollers consisting of a driving roller and a driven roller disposed below the driving roller and transporting a recording medium sandwiched between the driving roller and the driven roller, the driving roller having a pressing surface in an arc shape;

a table on which a plurality of recording media to be supplied to the pair of transporting rollers are stacked; and a table drive mechanism that moves the table between a transport position at which the uppermost recording medium of the recording media stacked on the table contacts the driving roller and a standby position, below the transport position, at which the uppermost recording medium does not contact the driving roller and, that includes a pusher disposed in a range outside an angle range corresponding to the pressing surface of the driving roller and rotating with the driving roller;

a stopper that has a contact surface facing to an upstream direction at a position which is upstream of a position at which the driving roller and the driven roller sandwich the recording medium, with respect to a transport direction of the recording medium by the pair of transporting rollers, and that enables leading ends of the recording media, except the predetermined number of the recording media from the uppermost of the recording media stacked on the table at the transport position, to contact the contact surface, thereby preventing the recording media, except the predetermined number of the recording media from the uppermost, from being supplied to the pair of transporting rollers, and a restacker that restacks the recording medium, wherein the pusher periodically pushes the table in synchronization with the transport of the recording medium by the pair of transporting rollers as the driving roller is rotated, wherein the table descends to the standby position from the transport position as being pushed by the pusher after the uppermost recording medium of the recording media stacked on the table at the transport position is sandwiched between the driving roller and the driven roller, thereby pushing the restacker, and wherein the restacker moves in a direction toward the table along a lower surface of the recording medium sandwiched between the pair of transporting rollers, as being pushed by the table, thereby restacking the recording medium, except the recording medium sandwiched between the pair of transporting rollers, among the predetermined number of the recording media from the uppermost, on the table.

2. The sheet transport apparatus according to claim 1, wherein the table drive mechanism includes an elastic member, and wherein the table descends to the standby position from the transport position while resisting elastic force of the elastic member.

3. A sheet transport apparatus comprising:

a pair of transporting rollers including a driving roller and a driven roller disposed below the driving roller and transporting a recording medium sandwiched between the driving roller and the driven roller, the driving roller having a pressing surface in an arc shape;

a table on which a plurality of recording media to be supplied to the pair of transporting rollers are stacked; and a table drive mechanism that moves the table between a transport position at which the uppermost recording medium of the recording media stacked on the table contacts the driving roller and a standby position, below the transport position, at which the uppermost recording medium does not contact the driving roller and, that includes a pusher disposed in a range outside an angle range corresponding to the pressing surface of the driving roller and rotating with the driving roller;

a stopper that has a contact surface facing to an upstream direction at a position which is upstream of a position at which the driving roller and the driven roller sandwich the recording medium, with respect to a transport direction of the recording medium by the pair of transporting rollers, and that enables leading ends of the recording media to contact the contact surface and a predetermined number of the recording media from the uppermost of the recording media stacked on the table is at the transport position, thereby preventing the recording media from being supplied to the pair of transporting rollers and the predetermined number of the recording media from the uppermost being supplied to the pair of transporting rollers, and a restacker that restacks the recording medium, wherein the pusher periodically pushes the table in synchronization with the transport of the recording medium by the pair of transporting rollers as the driving roller is rotated, wherein the table descends to the standby position from the transport position as being pushed by the pusher after the uppermost recording medium of the recording media stacked on the table at the transport position is sandwiched between the driving roller and the driven roller, and wherein the table when descending to the standby position contacts to the restacker and the table pushes one end of the restacker to pivot in a direction toward the table along a lower surface of the recording medium sandwiched between the pair of transporting rollers so that the restacker separates the recording medium between the recording medium sandwiched between the pair of transporting rollers, and the predetermined number of the recording media from the uppermost, on the table.

* * * * *